US011206885B2

(12) United States Patent
Sharpe

(10) Patent No.: US 11,206,885 B2
(45) Date of Patent: Dec. 28, 2021

(54) SHARP POINT TIE

(71) Applicant: Deonte Sharpe, Dumfries, VA (US)

(72) Inventor: Deonte Sharpe, Dumfries, VA (US)

(73) Assignee: Deonte Sharpe, Stafford, VA (US)

( * ) Notice: Subject to any disclaimer, the term of this patent is extended or adjusted under 35 U.S.C. 154(b) by 79 days.

(21) Appl. No.: 16/684,492

(22) Filed: Nov. 14, 2019

(65) Prior Publication Data

US 2021/0145095 A1 May 20, 2021

(51) Int. Cl.
*A41D 25/00* (2006.01)
*A44B 6/00* (2006.01)

(52) U.S. Cl.
CPC ..... *A41D 25/003* (2013.01); *A44B 6/00* (2013.01)

(58) Field of Classification Search
CPC .... A41B 3/12; A41B 3/04; A44B 6/00; A41D 25/12; A41D 25/003; A41D 25/00; A41D 25/02; A41D 25/027
USPC ... 2/137, 139, 140, 130, 144, 145, 146, 149, 2/151, 152.1, 154, 155, 156, 157
See application file for complete search history.

(56) References Cited

U.S. PATENT DOCUMENTS 1,308,731 A * 7/1919 Busby ..... A41D 25/003 2/145
2008/0276347 A1* 11/2008 Alfin ..... A41B 3/12 2/137

* cited by examiner

*Primary Examiner* — Gloria M Hale

(57) ABSTRACT

A wearable neck accessory, worn how a traditional necktie is worn. This tie does not connect at both ends, does not loop, knot or tie to be worn. This tie connects to the top button hole and loop of a shirt, or may stand alone with no attachment to the shirt. This tie is normally worn on open collared/un-buttoned shirts but is not limited to. Tie length can be adjusted in the middle of the tie.

3 Claims, 1 Drawing Sheet

SHARP POINT TIE

FIELD

The present application relates to wearable necktie apparel used for accessory as a traditional necktie is worn. This tie does not connect at both ends, does not loop, knot or tie to be worn. This tie adheres to the top button hole and loop of a shirt, or may stand alone with no attachment to the shirt. This tie is normally worn on open collared/un-buttoned shirts but is not limited to.

BACKGROUND

Embodiments of the invention is a wearable necktie to which it is attached to the button hole and loop of a collared shirt or stands alone around the collar. The tie is comprised of any material normally used for clothing and crafting. The tie is generally used for open collared shirts and has adjustability to adjust to different neck sizes. This tie does not connect at both ends, does not loop, knot or tie to be worn.

SUMMARY

The sharp point tie provides a new innovative fashion accessory. The tie allows freedom to dress casual, professional and comfortable with style. This allows people to wear their collar open, as well as wear a necktie. People can wear different colors, sizes and styles of the tie to appeal to the shirt that they choose to wear the tie with. This tie removes the everyday restrictions and discomfort of a knotted, or tied necktie.

BRIEF DESCRIPTION OF THE DRAWINGS

The detailed description of the presented invention will be demonstrated by drawings that show.

DETAILED DESCRIPTION

In the following detailed description, the provided drawings demonstrate the invention and its embodiments of materials, but is not limited to just this style, hardware etc. Additional hardware or materials could be other fasteners, clips, hook and loop fasteners, buttons, loops etc.

Figure 1:
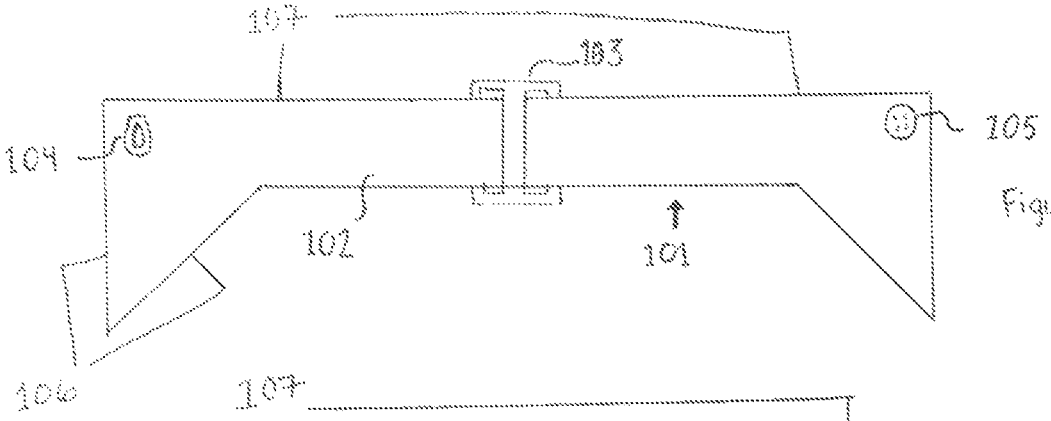
FIG. 1: Is an isometric drawing of the inner layer of the tie and the embodiments associated

The first drawing demonstration of the Sharp Point tie 101 is presented in FIG. 1. This is the inner region of the Tie demonstration. The material/cloth used 102 is the full tie foundation and primary source of the invention. To adjust the tie there is a looping hardware 103 demonstrated, where sizing of the length of the tie can be adjusted. The collared top button of any shirt worn would fasten in the loop demonstrated 104. The long part of the tie or the neck 107 would wrap around the back of the neck. The other end of the tie (the button end 105) would attach in the front of the other side of the neck to the button hole of the shirt. The point of the tie 106 then hangs down from the edge of the collar.

Figure 2:
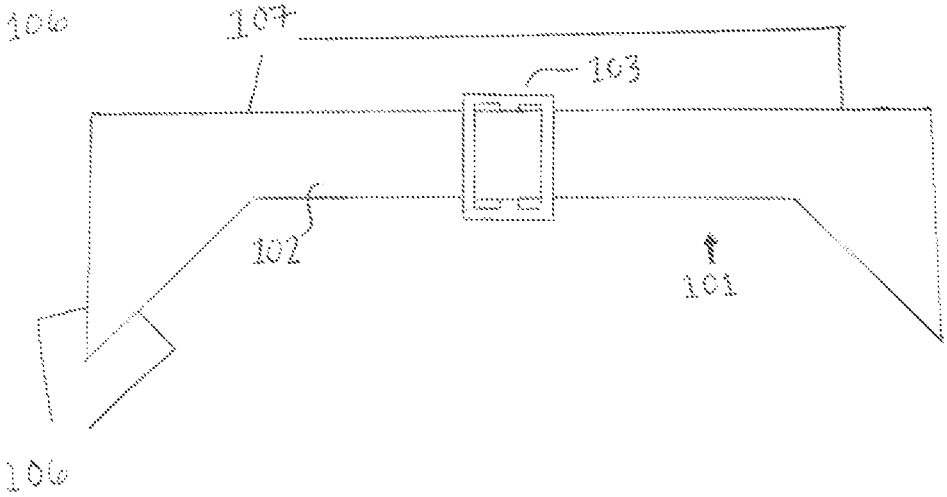
FIG. 2: Is an isometric drawing of the outer layer of the tie and the embodiments associated

The second drawing demonstration of the Sharp Point tie 101 is presented in FIG. 2. This is the outer region of the Tie demonstration. The material/cloth used 102 is the full tie foundation and primary source of the invention. To adjust the tie there is a looping hardware 103 demonstrated, where sizing of the length of the tie can be adjusted. The long part of the tie or the neck 107 would wrap around the back of the neck. The flaps of the tie on both sides 106 hang down from the edge of the collar on both sides of the collar, these are the parts that are most visible and is the primary focus of the entire tie.

The invention claimed is:

1. A necktie apparel accessory to wear on a shirt having a button and button hole around the neckline of said shirt comprising:

a linear band having a first and second end;

each of said first and second ends having and upper and lower corner;

said lower corners having a pointed corner;

said linear band including a central band portion including a band adjusting hardware in order to shorten or lengthen said linear band;

said first and second ends having a button or button hole therein said upper corner;

said first and second ends including a buttonhole or button of said upper corner that is of a type that is attachable and complementary to a button or buttonhole that is located about a traditional shirt neckline wherein when a wearer places said necktie accessory onto their neck over their shirt neckline the button or buttonhole located at said accessory upper corner is complementary and is attached to a buttonhole or button on the shirt it is worn with and said necktie accessory.

2. A necktie apparel accessory as claimed in claim 1, and further comprising said accessory being worn with an open collared shirt.

3. A necktie apparel accessory as claimed in claim 1, and further comprising said adjusting hardware as including any of a loop, snap, button, buttonhole, slider or clip to thereby adjust said linear band to different length sizes.

* * * * *